US007556231B2

(12) United States Patent
Herbst et al.

(10) Patent No.: US 7,556,231 B2
(45) Date of Patent: Jul. 7, 2009

(54) DISHWASHER RACK STEMWARE HOLDING APPARATUS

(75) Inventors: Steve M. Herbst, Redmond, WA (US); Ursula Hildenbrand, Redmond, WA (US)

(73) Assignee: Stemgrip, LLC, Mercer Island, WA (US)

( * ) Notice: Subject to any disclaimer, the term of this patent is extended or adjusted under 35 U.S.C. 154(b) by 113 days.

(21) Appl. No.: 10/876,152

(22) Filed: Jun. 24, 2004

(65) Prior Publication Data

US 2005/0236345 A1 Oct. 27, 2005

Related U.S. Application Data

(60) Provisional application No. 60/565,687, filed on Apr. 27, 2004.

(51) Int. Cl.
*A47F 5/00* (2006.01)

(52) U.S. Cl. ..... 248/316.1; 248/124.2; 248/540; 211/41.9

(58) Field of Classification Search ..... 248/124.2, 248/313, 316.1, 316.5, 316.6, 316.7, 540, 248/541, 229.1, 229.13; 211/41.8, 41.9
See application file for complete search history.

(56) References Cited

U.S. PATENT DOCUMENTS

| | | | | | |
|---|---|---|---|---|---|
| 2,523,785 | A * | 9/1950 | Sereno | 403/188 |
| 3,318,457 | A * | 5/1967 | Krasnoff | 211/74 |
| 3,989,213 | A * | 11/1976 | Allen | 248/214 |
| 4,121,798 | A | 10/1978 | Schumacher et al. | 248/113 |
| 4,589,556 | A | 5/1986 | Peretz | 211/41 |
| 4,927,033 | A | 5/1990 | Patera et al. | 211/41 |
| 5,288,047 | A | 2/1994 | Pan | 248/229 |
| 5,580,025 | A | 12/1996 | Cross | 248/507 |
| 5,636,815 | A * | 6/1997 | Wilson | 248/125.9 |
| 5,697,129 | A * | 12/1997 | Newville | 24/339 |
| 5,918,749 | A | 7/1999 | Pille et al. | 211/41.9 |
| 6,123,204 | A | 9/2000 | Nelson et al. | 211/41.9 |
| 6,364,131 | B1 | 4/2002 | Moylan | 211/41.9 |
| 6,394,285 | B1 | 5/2002 | Arthurs et al. | 211/41.9 |
| 6,802,484 | B1 * | 10/2004 | Kiley et al. | 248/311.2 |
| 6,966,086 | B2 * | 11/2005 | Metz et al. | 5/510 |
| 7,209,345 | B2 * | 4/2007 | Jang | 361/682 |

* cited by examiner

*Primary Examiner*—Amy J. Sterling
*Assistant Examiner*—Steven Marsh
(74) *Attorney, Agent, or Firm*—Dean A. Craine

(57) ABSTRACT

A dishwasher accessory for securing various sizes of stemware in a stable and upright position over a vertical tine on a dishwasher rack. The accessory includes an elongated body that is longitudinally aligned and slides over a tine. Formed on the lower end of the body is a longitudinally aligned slot designed to allow the elongated body to fully extended and rest against the lower end of the tine and the rack's horizontal framework. A perpendicular aligned clamping member attaches to the elongated body and attaches at its opposite end to the central stem on a piece of stemware. The clamping member is designed to grasp and hold the stem on an inverted, vertical aligned piece of stemware placed on the rack. Formed on the proximal end of the clamping member is an octagonal-shaped socket opening designed to receive the upper neck section on the elongated body that is also octagonal in cross-section.

10 Claims, 4 Drawing Sheets

DISHWASHER RACK STEMWARE HOLDING APPARATUS

This utility patent application is based upon and claims the benefit of the filing date of the provisional patent application (Ser. No. 60/565,687) filed on Apr. 27, 2004.

BACKGROUND OF THE INVENTION

1. Field of the Invention

This invention relates to rack supports and more particularly, to an apparatus for securing stemware on the rack of a dishwasher.

2. Description of the Related Art

A commonly known problem associated with washing stemware in a dishwasher is that the stemware often shifts or tips over during the washing process. When the stemware shifts or tips over, it often breaks or collects water or food debris that is normally washed away.

Dishwasher accessories specifically designed for holding stemware on the rack of a dishwasher have been developed. For example, U.S. Pat. No. 6,394,285 (Arthurs et.al) discloses such an accessory that includes an elongated member with a vertical wire enclosed bore formed on one end and two gripper jaws formed on the opposite end. During use, the end of the elongated member is perpendicularly aligned over a vertical tine on the dishwasher rack so that the bore slides onto the tine. The two-gripper jaws are then attached to the post of the stemware to hold the stemware in an inverted, vertical position on the rack.

The one drawback with the accessory disclosed in U.S. Pat. No. 6,394,285 is that the height of the tine limits the size of stemware that the accessory can hold.

Another drawback is that only one accessory and, hence only one stemware, can be used on a single tine, which creates large open areas on the rack when not filled with dishes.

A third drawback with the accessory is that the elongated member is not locked on the tine and is able to rotate on the tine when the dishwasher is operated. When rotation occurs, the stemware may tilt or fall to one side and collect water and food debris or contact other stemware or other dishes on the rack.

SUMMARY OF THE INVENTION

It is an object of the present invention to provide an apparatus for securely holding stemware in an upright position on the rack of a dishwasher.

It is an object of the present invention to provide such an apparatus for holding different sizes of stemware on the rack of a dishwasher.

It is another object of the present invention to provide such an apparatus that securely attaches to a tine and prevents movement of the stemware when the dishwasher is operated.

It is a further object of the present invention to provide such an apparatus that can be used with other similar apparatuses on a single tine therefore maximizing the cleaning space on the rack.

These and other objects are met by an apparatus for securing different sizes of stemware in a stable, inverted, vertical position on the rack of a dishwasher. The apparatus includes a tine engaging elongated body designed to engage a standard tine of the rack. During use, the elongated body is longitudinally aligned with the tine and designed to act as a tine extension. In the first embodiment, the elongated body includes a longitudinally aligned center bore that enables the elongated body to slide vertically over the tine. In a second embodiment, the elongated body includes at least one a clip element that enables the elongated body to attach to the side of the tine. In both embodiments, the elongated bodies are slightly longer than the tine and include an upper narrow neck section that extends above the upper end of the tine. In the preferred embodiment, the narrow neck section includes a plurality of radially aligned cam surfaces that are engaged by a perpendicularly aligned clamping member that is included. Formed on the lower end of the elongated body is an optional slot designed to allow the elongated body to partially extend downward below the end of the tine and rest against the horizontal longitudinal frame members on the rack, thereby rotationally fixing the elongated body on the tine.

The apparatus also includes an adjustable clamping member that attaches at one end to the narrow neck section on the elongated body. During assembly, the clamping member is perpendicularly aligned over the elongated body. The distal end of the clamping member is attached to the central stem on a piece of stemware that is inverted and aligned vertically on the rack and adjacent to the tine. In the preferred embodiment, the clamping member includes two moveable jaws and biasing means disposed between them designed to securely force the two jaws around the central stem. Formed on the proximal end of the clamping member is a socket opening complementary in shape to the cross-sectional shape of the narrow neck section on the elongated body. During use, the socket opening slides onto the narrow neck section to rotatably lock the clamping member in a fixed position on the elongated body. In the preferred embodiment, the narrow neck section is sufficient in length so that at least two clamping members may be simultaneously attached to the elongated body.

DESCRIPTION OF THE PREFERRED EMBODIMENT(S)

Figure 1:
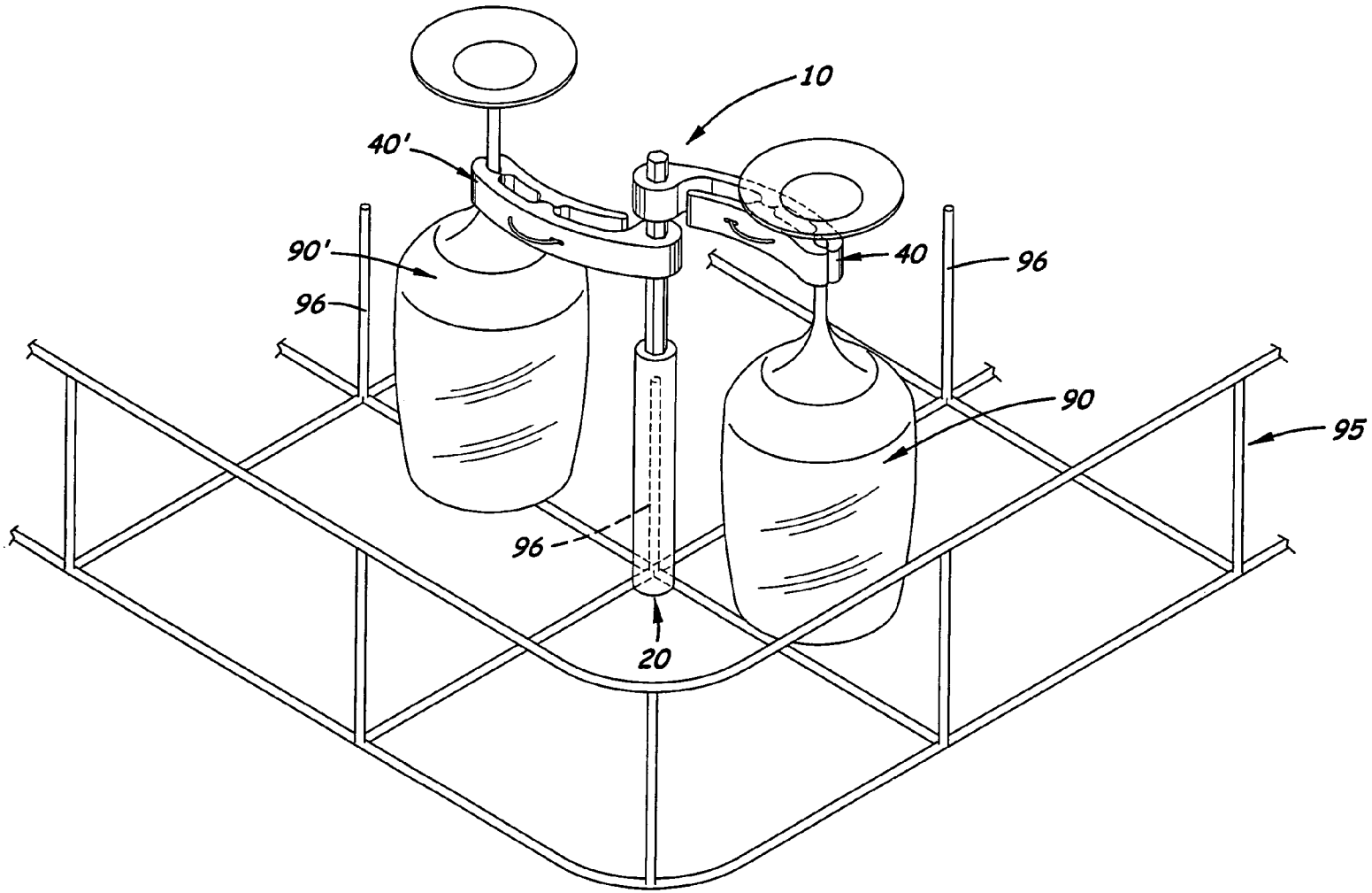
FIG. 1 is a perspective view of two apparatuses attached to a single tine on a dishwasher rack and one used to hold the two pieces of stemware in a vertical alignment on the rack.
Figure 2:
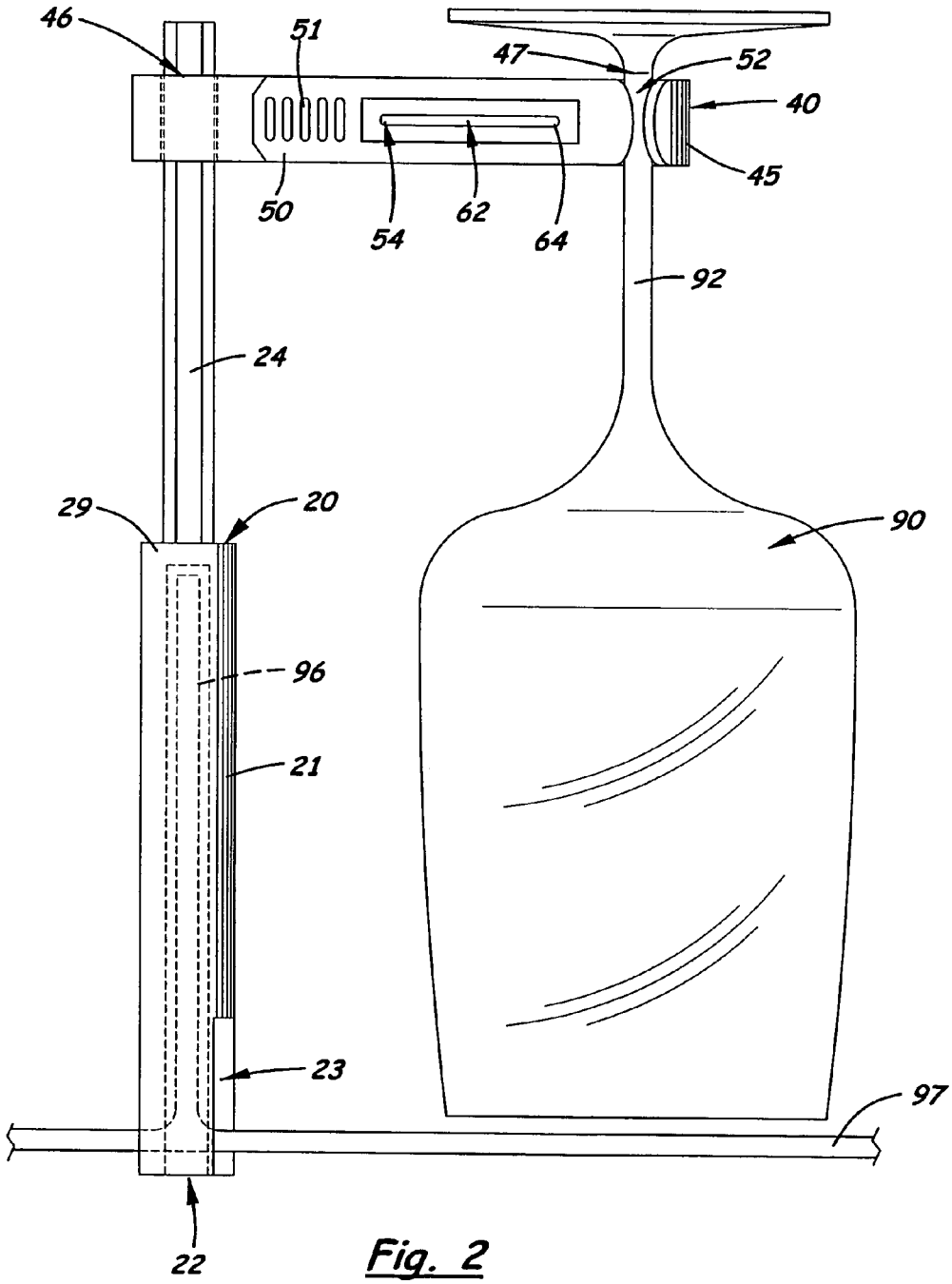
FIG. 2 is a side elevational view of the first embodiment of the apparatus showing an elongated body with a center bore formed therein that receives and attaches to a clamp member used to hold a piece of stemware in an inverted, vertical alignment on a dishwasher rack.

Disclosed herein is a dishwasher apparatus, generally indicated by 10, for securing various sized stemware 90 in a stable, inverted upright position on a dishwasher rack 95. The first embodiment of the apparatus 10 includes an elongated body 20 that is longitudinally aligned and attaches to a tine 96 on the rack 95. As shown in FIG. 2, the elongated body 20 includes a wide cylindrical lower section 21 with a longitudinally aligned bore 22 formed therein which enables the elongated body 20 to slide vertically over the tine 96. Formed on the proximal end of the lower section 21 is an optional longitudinally aligned side slot 23 designed to allow the elongated body 20 to rest against the horizontal framework 97 on the rack 95 thereby locking the elongated body 20 over the tine 96 and preventing its rotation.

The elongated body 20 also includes an upper, narrow neck section 24 designed to extend one to three inches above the upper end of the tine 96. In the preferred embodiment, the neck section 24 is octagonal in cross-section as shown in FIG. 3 and slightly smaller than the lower section 21 thereby creating a shoulder 29 that limits the downward movement to the clamping member 40 discussed further below.

Figure 3:
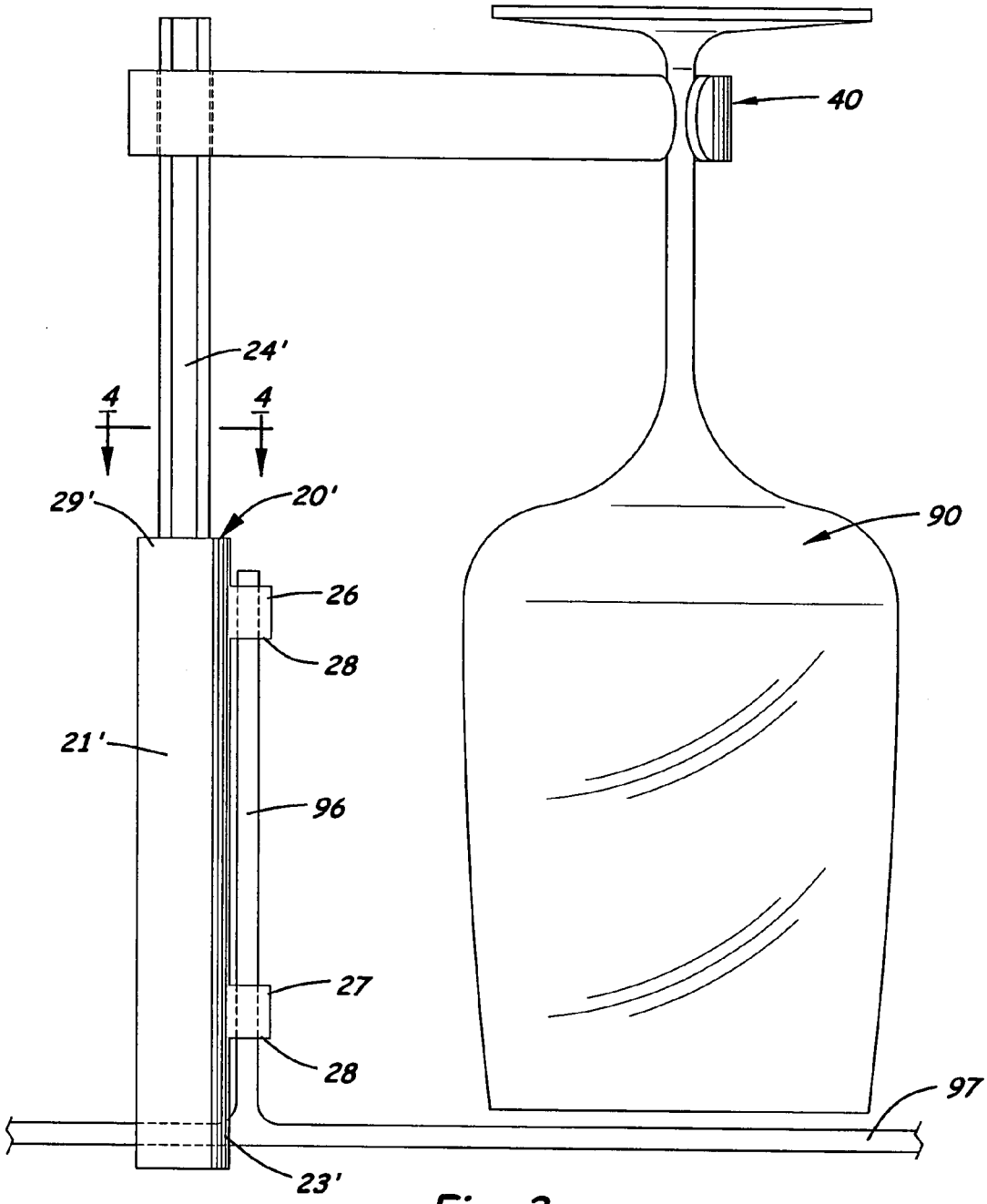
FIG. 3 is a side elevational view of the second embodiment of the invention showing an elongated body that is longitudinally aligned on one side of the tine and then uses two lateral clips to engage the tine.
Figure 4:
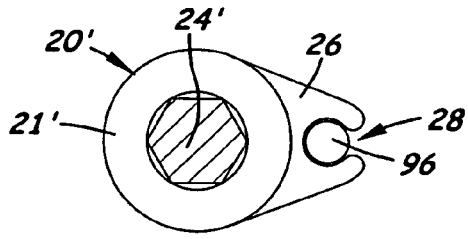
FIG. 4 is a sectional, top plan view of the apparatus taken along line 4-4 in FIG. 3.

FIGS. 3 and 4 show a second embodiment of the elongated body, denoted 20', that includes a lower section 21' and an upper, narrow neck section 24'. Attached to the lower section 21' is at least one clip that snap fits the lower section 21' to attach to the tine 96. In the preferred embodiment, the apparatus 10 uses two laterally extended clips 26, 27. Each clip 26 or 27 includes a u-shaped slot 28 that snap fits tightly around the tine 96 to hold the lower section 21' on the tine 96. The upper neck section 24' is identical to the upper neck section 24 used on the first embodiment and used to hold at least one adjustable clamping member 40.

The adjustable clamping member 40 attaches at one end of the narrow neck sections 24, 24'. As shown more clearly in FIG. 5, the clamping member 40 includes two moveable jaws 45, 50 and biasing means disposed between them designed to force the two jaws 45, 50 together to grasp the center stem 92 on a piece of stemware 90 inverted and aligned vertically on the rack 95 and adjacent to the tine 96. Formed on the proximal end of the clamping member 40 is an octagonal-shaped socket opening 65 designed to slide over the neck section 24 on the elongated body 20. Because the socket opening 65 is octagonal in cross-section, the clamping member 40 is automatically fixed in position on the elongated body 20 and prevented from rotating thereover when the dishwasher 10 is operated.

In both embodiments, the elongated body 20, 20' is approximately seven inches in overall length. The narrow neck sections 24, 24' are approximately ¼ inch in diameter and approximately three inches in length. The lower sections 21, 21' are approximately four inches in length and ½ inch in diameter. The longitudinal bore 22 formed on the elongated body 20 and the 22' formed on the elongated body 20' are approximately 3/16 in diameter. The lengths of the bores 22, 22' and the locations of the clips 26, 27 are sufficient so that the entire tine 96 is engaged. Also, in both embodiments the neck sections 24, 24' are solid and the shoulders 29, 29' are formed between the neck sections 24, 24' and the lower sections 21, 21', respectively. With the first embodiment, the side slot 23, formed on the elongated body 20 communicates with the longitudinal bore 22 and extends longitudinally upward from the distal end of the elongated body 20 approximately 1-¼ inches. A side slot 23' may also be formed on the lower end of the elongated body 20' which is used to lock the elongated body 20 on the rack's lower framework 97.

Figure 5:
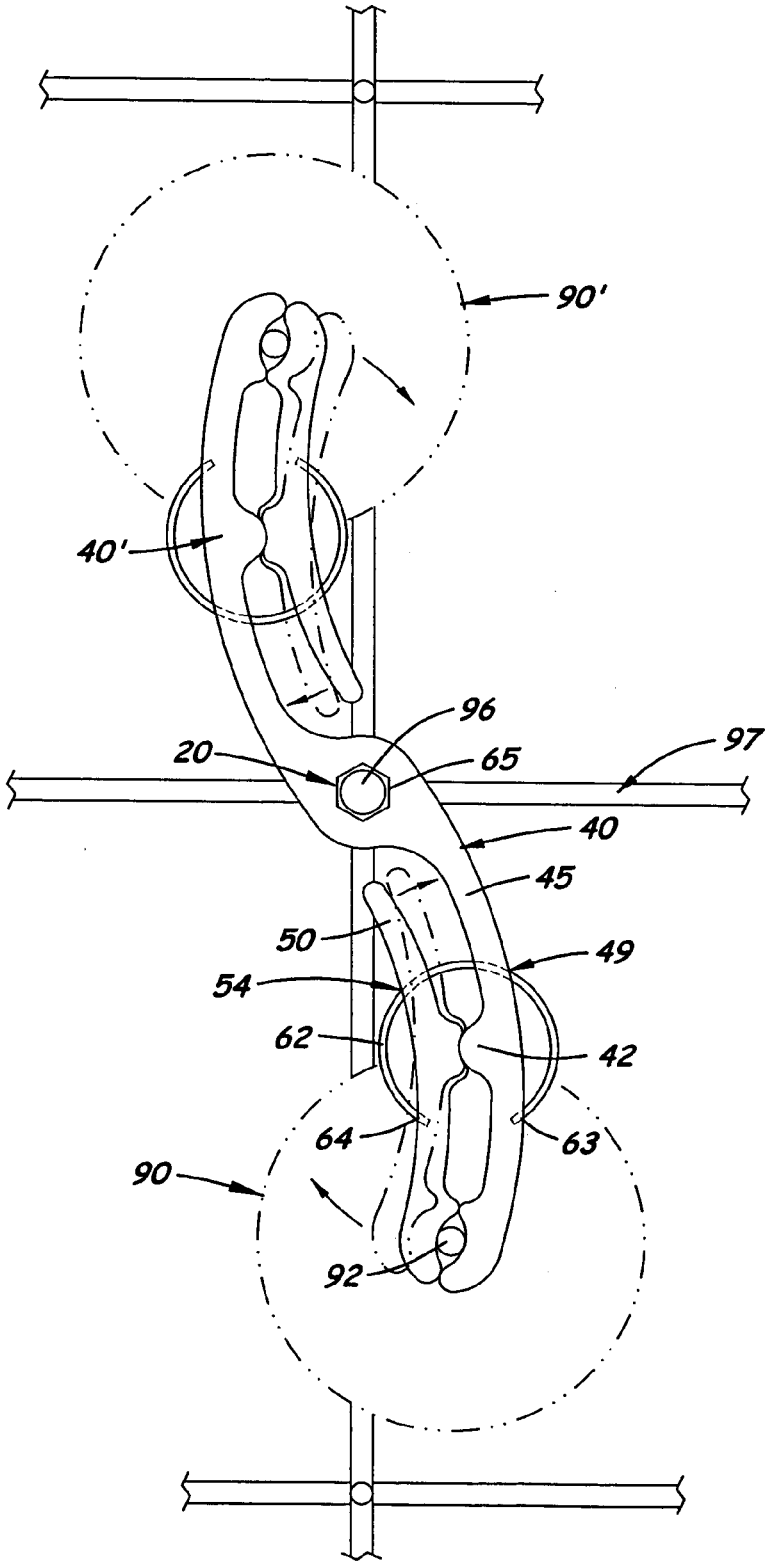
FIG. 5 is a top plan view of two apparatus attached to a single tine and used to securely hold two pieces of stemware on a dishwasher rack.

As shown in FIG. 5, the clamping member 40 is a curved, wing-shaped structure approximately 4 inches in length. The clamping member 40 includes main and secondary jaw members 45, 50, respectfully, pivotally connected together at a center joint 42. Formed on the main jaw member 45 is the center bore 46 that slides onto the narrow neck section 24 on the elongated body 20. The main jaw member 45 and secondary jaw member 50 are aligned in the same horizontal plane. The secondary jaw member 50 is shorter than the main jaw member 45 and includes a finger gripping surface 51 that rotates toward the main jaw member 45 when the distal ends of the main and secondary jaw members 45, 50 are forced opened, (see direction of arrows in FIG. 3). Formed on the distal ends of the main and secondary jaw members 45, 50 are two complimentary shaped, one half openings 47, 52, respectively, that surround and encapsulate the center stem 92 on a piece of stemware 90 to securely hold the stemware 90 on the rack 95.

In the preferred embodiment, the biasing means is a transversely aligned split ring 62 that extends between the main and secondary jaw members 45, 50. The split ring 62 extends through small openings 49, 54 formed on the two jaw members 45, 50. The two unattached ends 63, 64 of the split ring 62 press against the outer surfaces of the two jaw members 45, 50 to forcibly push them together.

As shown in FIG. 5, the accessory 10 is designed so that one to four clamping members 40, 40' may be used with one elongated body 20. Because the neck section 24 is octagonal in cross section and is engaged by the center bore 46, each clamping member 40, is locked in position on the elongated body 20 to prevent the pieces of stemware 90, 90' from moving on the rack 95 when the dishwasher 10 is operated. Because the center bore 46 is slightly larger in diameter then the neck 24, each clamping member 40 slides vertically and freely over the neck section 24, thereby enabling the apparatus 10 to be used with different sizes of stemware 90. In the preferred embodiment, the apparatus 10 is made of heat tolerant plastic or similar material. While the clamping member 40 is described in the preferred embodiment to be a wing-shaped structure it should be understood that it is not limited to this particular shape.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

We claim:

1. A dishwasher rack stemware holding device comprising:

a. an elongated body having a longitudinally aligned lower section and a upper neck section;

b. longitudinally aligned bore formed in said lower section of said elongated body enabling said elongated body to slide longitudinally over the tine on a dishwasher rack so that said upper neck section extends above the tine;

c. a longitudinally aligned slot formed on said elongated member opposite said lower section thereby enabling said elongated body to partially engage a horizontal member on a dishwasher rack when longitudinally aligned over a tine;

d. a clamping member selectively attached to said upper neck section on said elongated body, said clamping member being perpendicularly aligned with said elongated body when attached thereto and including a means for clamping the stem on a vertically aligned piece of stemware located on the dishwasher rack and adjacent to a tine located on the dishwasher rack; and, e. a means for preventing rotation of said clamping member on said upper neck section.

2. The holding device, as recited in claim 1, wherein said clamping member includes a main jaw member and a secondary jaw member pivotally connected together, said main jaw member and secondary jaw member capable of grasping the stem on a piece of stemware to hold the piece of stemware in a vertically aligned position on a dishwasher rack.

3. The holding device, as recited in claim 1, wherein said upper neck section is sufficient in length to allow at least two clamping members to be attached thereto.

4. The holding device, as recited in claim 2, further including a biasing means disposed between said main jaw member and said secondary jaw member to force said main jaw member and said secondary jaw member together.

5. A dishwasher rack stemware holding device, comprising:

a. an elongated body having a longitudinally aligned lower section and a upper neck section;

b. a means for attaching and longitudinally aligning said elongated body to a tine on a dishwasher rack so that said upper neck section is longitudinally aligned and extends above the tine;

c. a clamping member removably attached to said upper neck section on said elongated body, said clamping member being perpendicularly aligned and extends laterally from said elongated body when attached thereto and including a means for clamping the stem on a vertically aligned piece of stemware located on the dishwasher rack and adjacent to a tine located on the dishwasher rack, said clamping member includes a main jaw member and a secondary jaw member pivotally connected together, said main jaw member and secondary jaw member capable of grasping the stem on a piece of stemware to hold the piece of stemware in a vertically aligned position on a dishwasher rack, said clamping member further including a transversely aligned split ring disposed between said main jaw member and said secondary jaw member to force said main jaw member and said secondary jaw member together; and, d. a means for preventing rotation of said clamping member on said upper neck section.

6. A dishwasher rack stemware holding device comprising:

a. an elongated body having a longitudinally aligned lower section and a upper neck section;

b. a means for attaching and longitudinally aligning said elongated body to a tine on a dishwasher rack so that said upper neck section is longitudinally aligned and extends above the tine;

c. a clamping member removably attached to said upper neck section on said elongated body, said clamping member being perpendicularly aligned and extends laterally from said elongated body when attached thereto and including a means for clamping the stem on a vertically aligned piece of stemware located on the dishwasher rack and adjacent to a tine located on the dishwasher rack; and, d. a means for preventing rotation of said clamping member on said upper neck section, said means for preventing rotation of said clamping member on said upper neck section is a plurality of cam surfaces formed on said upper neck section and a complimentary-shaped bore opening formed on said clamping member thereby preventing said clamping member from rotating over said upper neck section when attached thereto.

7. The holding device, as recited in claim 6, further including a longitudinally aligned slot formed on said elongated member opposite said upper neck section thereby enabling said elongated body to partially engage a horizontal member on a dishwasher rack when longitudinally aligned over a tine.

8. The holding device, as recited in claim 5, wherein said upper neck section is sufficient in length to allow at least two clamp members to be attached thereto.

9. The holding device, as recited in claim 6, wherein said upper neck section is sufficient in length to allow at least two clamp members to be attached thereto.

10. The holding device, as recited in claim 6, wherein said upper neck section is sufficient in length to allow at least two clamp members to be attached to said elongated member.

* * * * *